US005480140A

United States Patent [19]

Darnell

[11] Patent Number: 5,480,140

[45] Date of Patent: Jan. 2, 1996

[54] BATH TUB BASKETBALL GAME

[76] Inventor: Joseph L. Darnell, Rte. 1 Box 34J Doolittle Rd., Priest River, Id. 83856

[21] Appl. No.: 305,844

[22] Filed: Sep. 14, 1994

[51] Int. Cl.[6] ..... A63B 63/08

[52] U.S. Cl. ..... 273/15 R; 248/340

[58] Field of Search ..... 273/1.5 R, 1.5 A; D21/201; 248/340

[56] References Cited

U.S. PATENT DOCUMENTS

| | | | |
|---|---|---|---|
| 2,049,593 | 8/1936 | Schabinger | D21/201 X |
| 2,053,635 | 9/1936 | Sandberg | D21/201 X |
| 3,752,477 | 8/1973 | Hoyt | 273/1.5 R |
| 4,145,044 | 3/1979 | Wilson et al. | 273/1.5 R |
| 4,887,812 | 12/1989 | Moormann | 273/1.5 R |
| 5,007,637 | 4/1991 | Foley | 273/1.5 R |

OTHER PUBLICATIONS

Hong Cong Development Council, Hong Kong Toys, Jan. 1992, p. 269 Aim N' Shoot Foam Basketball Basketball Game Set #6818; Mini Basketball Set.

*Primary Examiner*—Paul E. Shapiro

[57] ABSTRACT

A new and improved bath-tub basketball game with a basketball hoop with an upper surface and a lower surface. The lower surface has a plurality of securement eyes thereon. The basketball hoop has a circular shape with an eight inch diameter. The basketball hoop has suction cups for coupling to a wall of the bathtub. A net has a plurality of U-shaped securement strings thereattached for coupling with the plurality of securement eye of the lower surface of the basketball hoop. A sponge ball serves as a ball to shoot through the basketball hoop and as a device for washing.

2 Claims, 4 Drawing Sheets

FIG 1
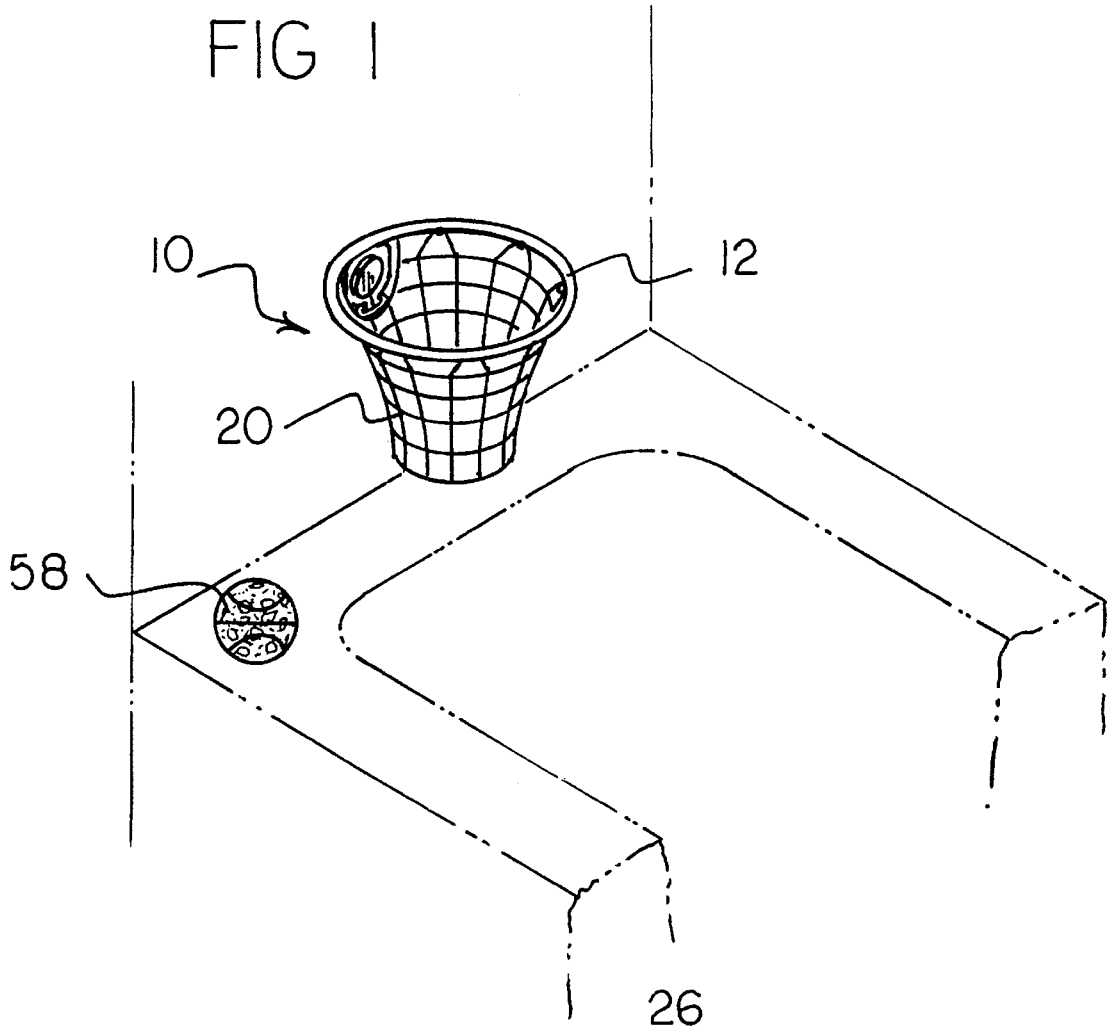
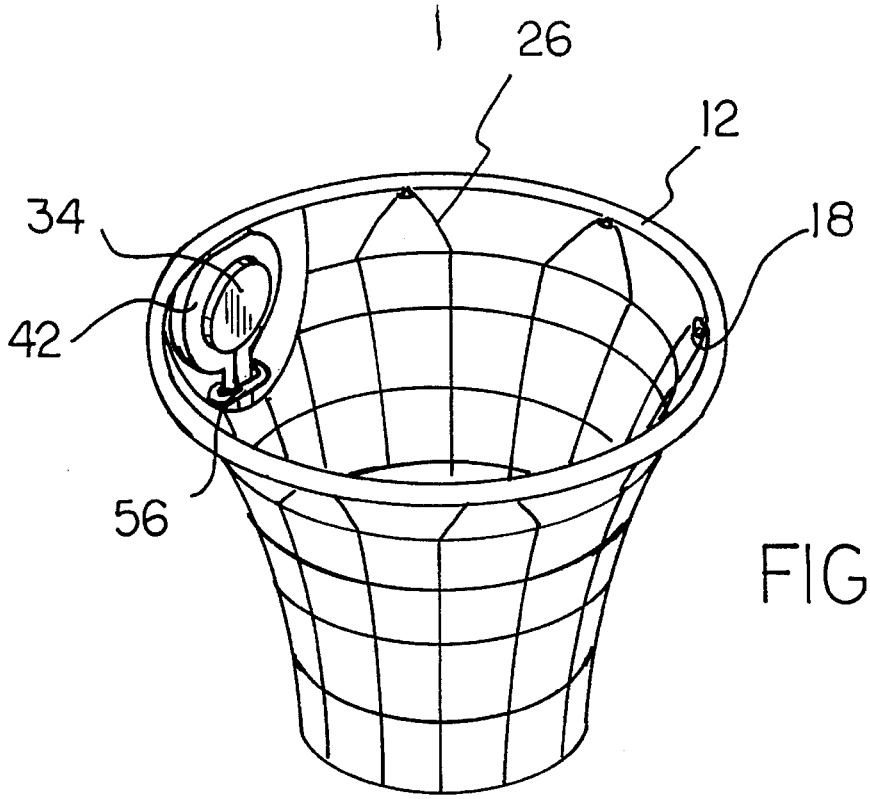
FIG 2

FIG 3
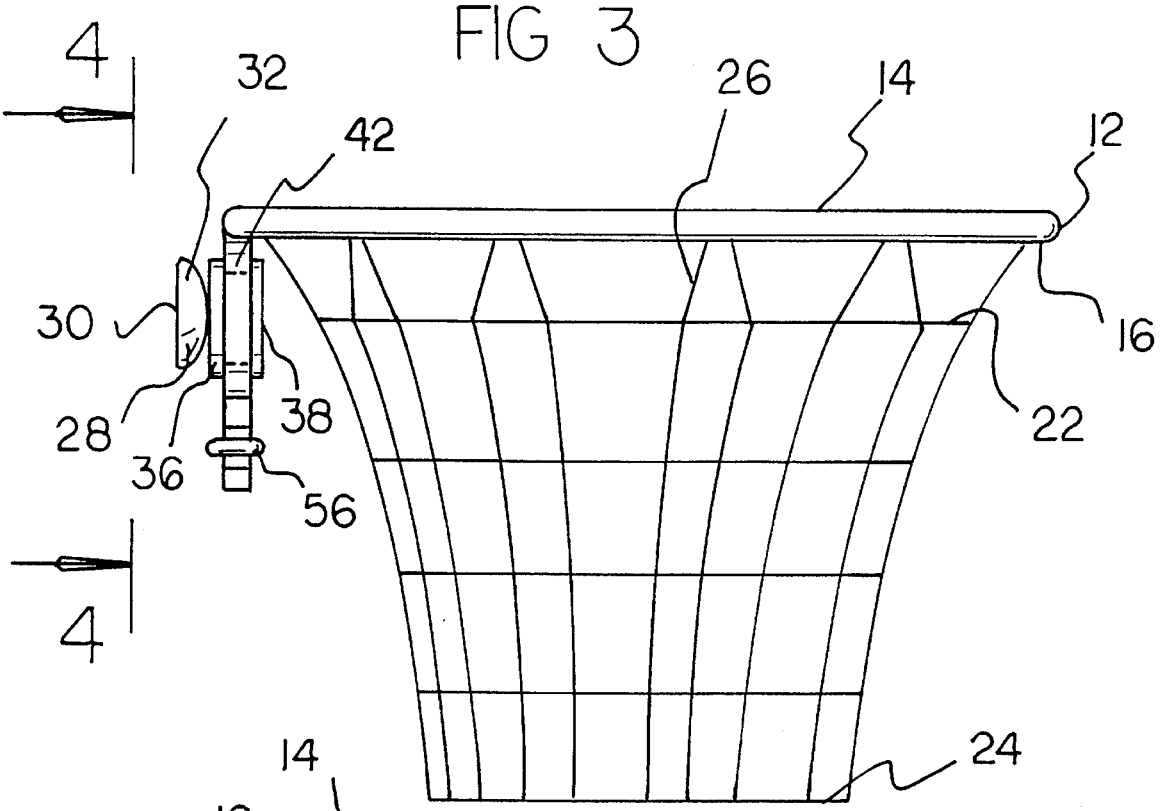
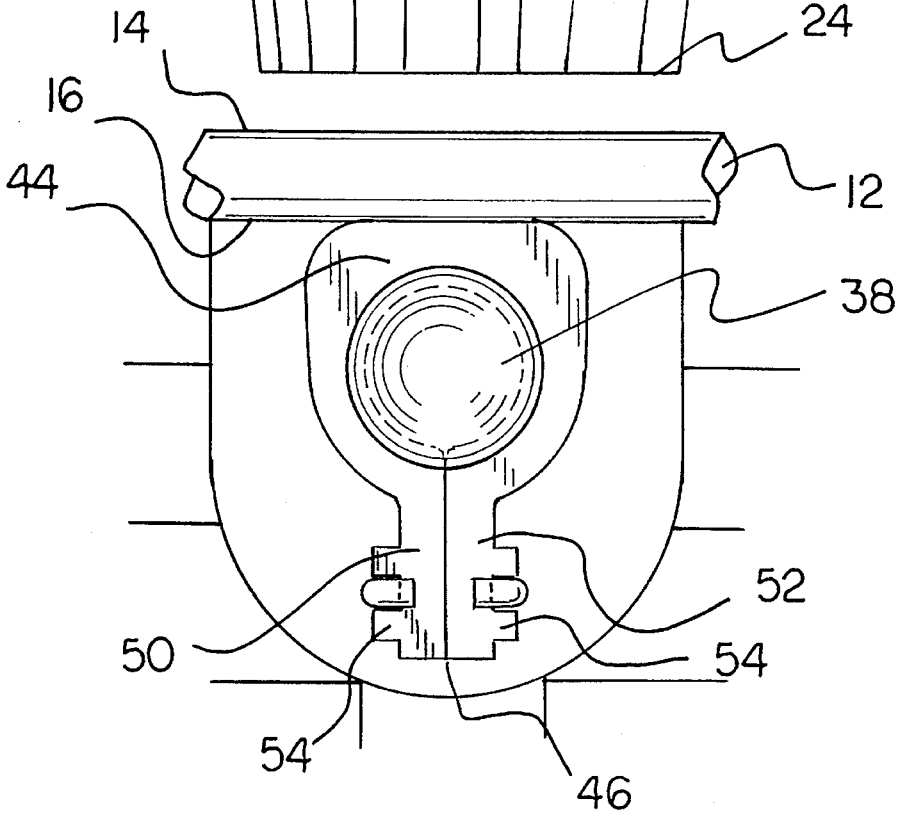
FIG 4

FIG 5
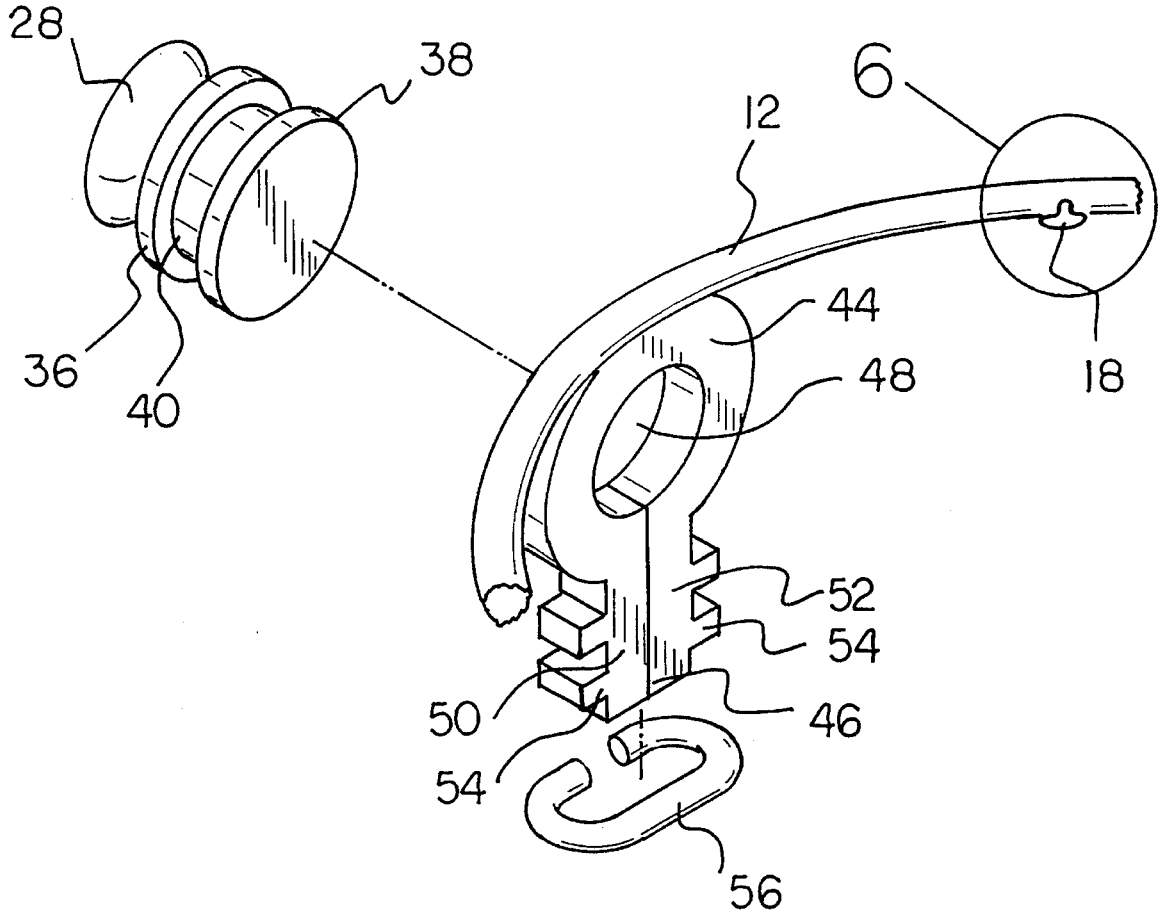
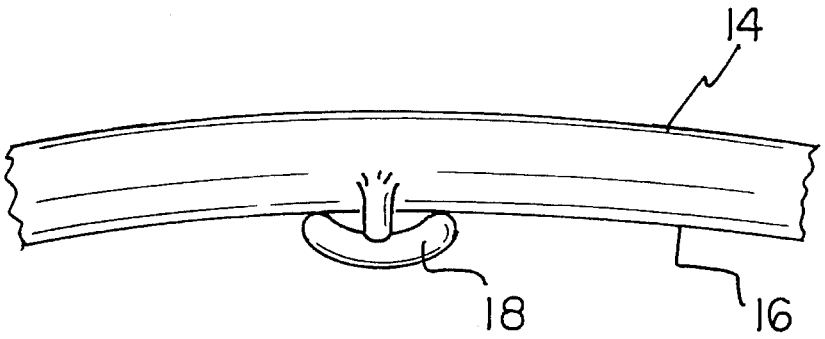
FIG 6

BATH TUB BASKETBALL GAME

BACKGROUND OF THE INVENTION

1. Field of the Invention

The present invention relates to a scrub-a-dub-hoop and more particularly pertains to providing enjoyment for a user in the bathtub with a simulated basketball game with a scrub-a-dub-hoop.

2. Description of the Prior Art

The use of basketball hoops is known in the prior art. More specifically, basketball hoops heretofore devised and utilized for the purpose of playing basketball are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,613,136 to Raba et al. discloses a pool side hoop game backboard.

U.S. Pat. No. 5,007,637 to Foley discloses a selectively mountable basketball hoop structure.

U.S. Pat. No. 4,468,027 to Pangburn discloses a miniature basketball backboard assembly attachable to a doorframe, door, or the like.

U.S. Pat. No. 5,037,093 to Roark, Jr. discloses a poolside basketball goal.

U.S. Pat. No. 3,669,450 to Mason discloses a portable and adjustable miniature basketball goal.

While these devices fulfill their respective, particular objective and requirements, the aforementioned patents do not describe a scrub-a-dub-hoop for providing enjoyment for a user in the bathtub with a simulated basketball game.

In this respect, the scrub-a-dub-hoop according to the present invention substantially departs from the conventional concepts and designs of the prior art, and in doing so provides an apparatus primarily developed for the purpose of providing enjoyment for a user in the bathtub with a simulated basketball game.

Therefore, it can be appreciated that there exists a continuing need for a new and improved scrub-a-dub-hoop which can be used for providing enjoyment for a user in the bathtub with a simulated basketball game. In this regard, the present invention substantially fulfills this need.

SUMMARY OF THE INVENTION

In the view of the foregoing disadvantages inherent in the known types of basketball hoops now present in the prior art, the present invention provides an improved scrub-a-dub-hoop. As such, the general purpose of the present invention, which will be described subsequently in greater detail, is to provide a new and improved scrub-a-dub-hoop and method which has all the advantages of the prior art and none of the disadvantages.

To attain this, the present invention essentially comprises a basketball hoop having an upper surface and a lower surface. The lower surface has a plurality of securement eyes thereon. The basketball hoop has a circular shape with an eight inch diameter. The device contains a net having an upper end and a lower end. The upper end has a plurality of U-shaped securement strings thereattached. The U-shaped securement strings are adapted for coupling with the plurality of securement eyes of the lower surface of the basketball hoop. The device contains a suction cup having an outer surface and an inner surface. The outer surface is adapted for securement to a bathroom wall. The device contains a circular molded plastic piece having a first edge, a second edge, and an intermediate groove therebetween. The first edge is secured to the inner surface of the suction cup. The device contains a molded plastic rim base having an upper end and a lower end. The upper end is integral with the lower surface of the basketball hoop. A securement aperture is formed downward of the upper end. The lower end has a first extent and a second extent parallel to each other. The first extent has a slot key end integral with an outer surface thereof. The second extent has a slot key end integral with an outer surface thereof. The first extent and the second extent are capable of separating to allow the securement aperture to secure to the intermediate groove of the circular molded plastic piece of the suction cup. The device contains a generally U-shaped clasp that is removably secured to the slot key end of the first extent and the second extent of the molded plastic rim base. The clasp serves to provide a tight fit around the circular molded plastic piece. Lastly, the device contains a sponge ball serving as a ball to shoot through the basketball hoop and as a means of washing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved scrub-a-dub-hoop which has all the advantages of the prior art basketball hoops and none of the disadvantages.

It is another object of the present invention to provide a new and improved scrub-a-dub-hoop which may be easily and efficiently manufactured and marketed.

It is a further object of the present invention to provide a new and improved scrub-a-dub-hoop which is of durable and reliable construction.

An even further object of the present invention is to provide a new and improved scrub-a-dub-hoop which is susceptible of a low cost of manufacture with regard to both materials and labor, and which accordingly is then susceptible of low prices of sale to the consuming public, thereby making such a scrub-a-dub-hoop economically available to the buying public.

Still yet another object of the present invention is to provide a new and improved scrub-a-dub-hoop which provides in the apparatuses and methods of the prior art some of the advantages thereof, while simultaneously overcoming some of the disadvantages normally associated therewith.

Even still another object of the present invention is to provide a new and improved scrub-a-dub-hoop for providing enjoyment for a user in the bathtub with a simulated basketball game.

Lastly, it is an object of the present invention to provide a new and improved scrub-a-dub-hoop with a basketball hoop having an upper surface and a lower surface. The lower surface has a plurality of securement eyes thereon. The basketball hoop has a circular shape with an eight inch diameter. The basketball hoop has a securement means for coupling to a wall of the bathtub. A net has a plurality of U-shaped securement strings thereattached for coupling with the plurality of securement eyes of the lower surface of the basketball hoop. A sponge ball serves as a ball to shoot through the basketball hoop and as a means of washing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the present invention in place in a bathtub.

FIG. 2 is a perspective view of the preferred embodiment of the scrub-a-dub-hoop constructed in accordance with the principles of the present invention.

FIG. 3 is a side elevational view of the present invention.

FIG. 4 is an enlarged plan view of the suction cup of the present invention as seen along line 4—4 of FIG. 3.

FIG. 5 is a partial exploded perspective view of the suction groove and the hoop attachment of the present invention.

FIG. 6 is an enlarged perspective view of the net hook taken from FIG. 5.

The same reference numerals refer to the same parts through the various Figures.

DESCRIPTION OF THE PREFERRED EMBODIMENT

Figure 7:
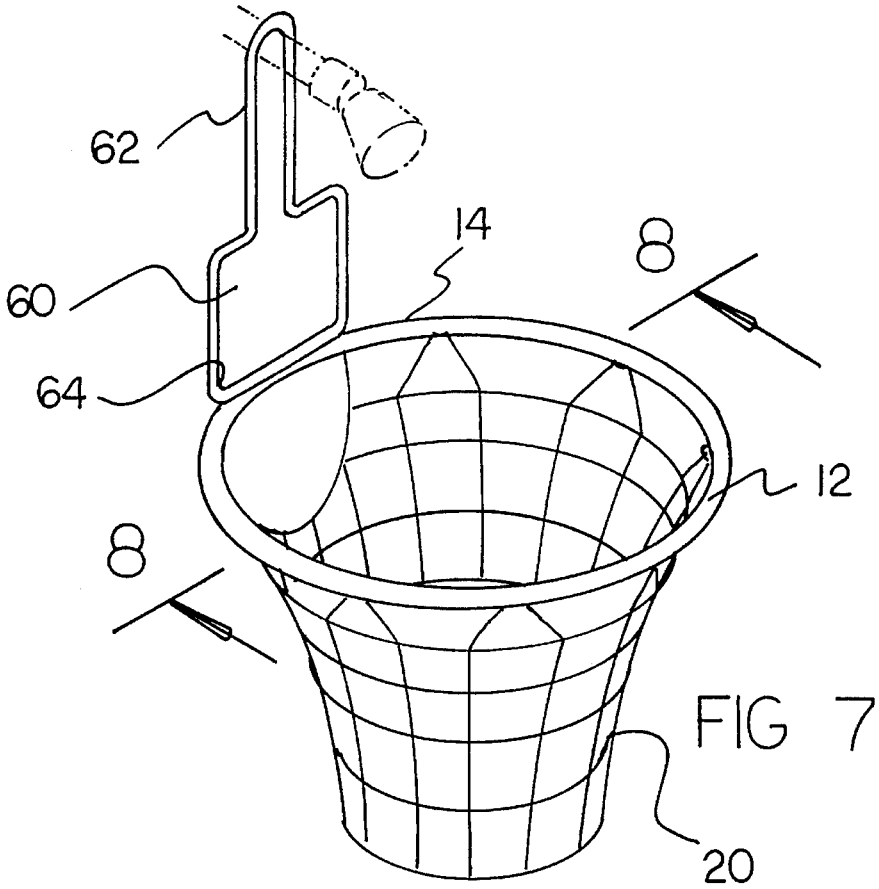
FIG. 7 is a perspective view of the second embodiment of the present invention.
Figure 8:
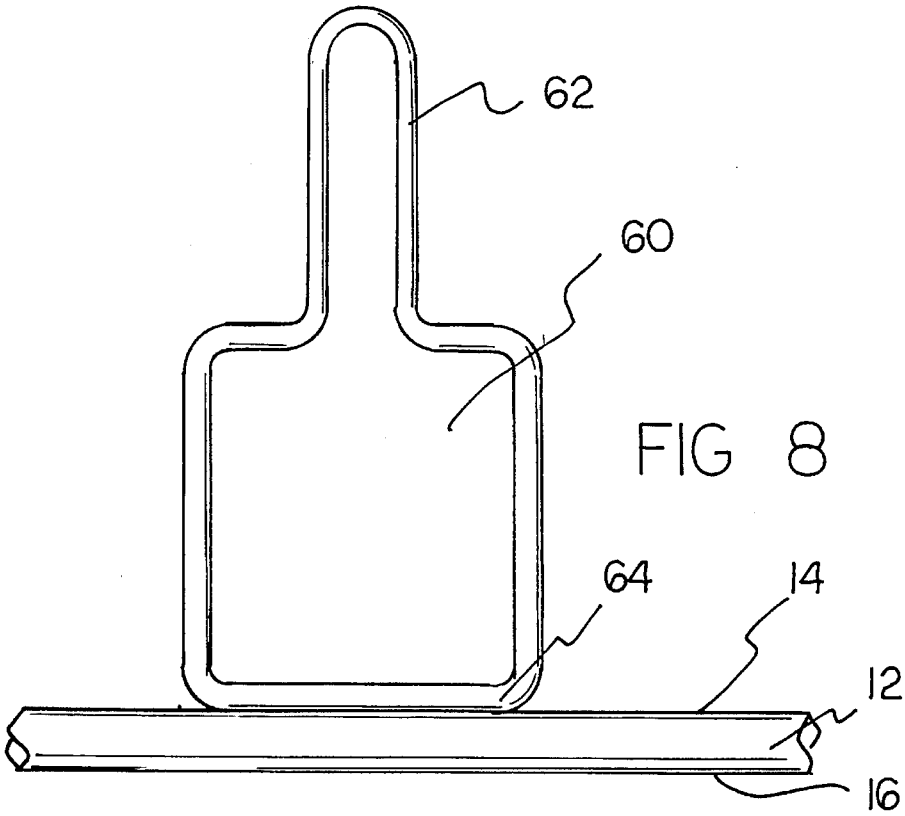
FIG. 8 is a cross-sectional view taken along line 8—8 of FIG. 7.

With reference now to the drawings, and in particular, to FIG. 1 thereof, the preferred embodiment of the new and improved scrub-a-dub-hoop embodying the principles and concepts of the present invention and generally designated by the reference number 10 will be described.

Specifically, it will be noted in the various Figures that the device relates to a new and improved scrub-a-dub-hoop for providing enjoyment for a user in the bathtub with a simulated basketball game. In its broadest context, the device consists of a basketball hoop, a net, a suction cup, a molded plastic rim base, a generally U-shaped clasp, and a sponge ball.

The device 10 contains a basketball hoop 12 having an upper surface 14 and a lower surface 16. The lower surface 16 has a plurality of securement eyes 18 thereon. The basketball hoop 12 has a circular shape with an eight inch diameter. The hoop 12 is constructed of a light weight plastic material for ease of application and to keep costs at a minimum. The diameter of the hoop is not limited to eight inches and can be constructed either larger or smaller to the consumers preference.

The device 10 contains a net 20 having an upper end 22 and a lower end 24. The upper end 22 has a plurality of U-shaped securement strings 26 thereattached. The U-shaped securement strings 26 are adapted for coupling with the plurality of securement eyes 18 of the lower surface 16 of the basketball hoop 12. The upper end 22 of the net is slightly larger than the lower end 24. The upper end 22 conforms to be secured to the hoop 12, while the lower end 24 tapers to control a ball as it is received in the net 20.

The device 10 contains a suction cup 28 having an outer surface 30 and an inner surface 32. The outer surface 30 is adapted for securement to a bathroom wall. The device 10 contains a circular molded plastic piece 34 having a first edge 36, a second edge 38, and an intermediate groove 40 therebetween. The first edge 36 is secured to the inner surface 32 of the suction cup 28. The size of the suction cup 28 is dependent on the size of the hoop 12. A larger hoop 12 would require a larger suction cup 28.

The device 10 contains a molded plastic rim base 42 having an upper end 44 and a lower end 46. The upper end 44 is integral with the lower surface 16 of the basketball hoop 12. A securement aperture 48 is formed downward of the upper end 44. The lower end 46 has a first extent 50 and a second extent 52 parallel to each other. The first extent 50 has a slot key end 54 integral with an outer surface thereof. The second extent 52 has a slot key end 54 integral with an outer surface thereof. The first extent 50 and the second extent 52 are capable of separating to allow the securement aperture 48 to secure to the intermediate groove 40 of the circular molded plastic piece 34 of the suction cup 28.

The device 10 contains a generally U-shaped clasp 56 that is removably secured to the slot key end 54 of the first extent 50 and the second extent 52 of the molded plastic rim base. The clasp serves to provide a tight fit around the circular molded plastic piece 42. The clasp 56 would also control the amount of bounce accompanying the hoop 12 when struck by a ball.

Lastly, the device 10 contains a sponge ball 58 serving as a ball to shoot through the basketball hoop 12 and as a means of washing. The size of the sponge ball 58 is also dependent on the size of the hoop 12. The sponge will also replicate a basketball by having lines extending across the surface to simulate the seams that are present on a basketball.

A second embodiment of the present invention is shown in FIG. 7 and includes substantially all of the components of the present invention further including wherein a securement means is a shower head attachment 60 having an upper end 62 and a lower end 64. The lower end 64 is secured to the upper surface 14 of the basketball hoop 12. The upper end 62 is removably secured about a shower head.

The present invention is a bathtub toy for children age five and up in the shape of a basketball hoop 12 and sponge ball 58 which can be used on smooth bathtub surfaces.

The basketball hoop 12 is manufactured from a light-weight plastic material and includes a hoop which measures 8 inches in diameter. A small net 20 is attached to the rim of the hoop by eight eyes 18 which secure the net strings in place. A molded plastic rim base\mount 42 is located along one side of the hoop 12 and features a large suction cup 28 that secures the device 10 to the tile wall. This mount 42 includes two slot key ends 54 between which the hoop rim is placed for a tight fit and to prevent excessive rim bounce. The ball 58 is formed from a sponge material and can also be used for washing. This toy can also be produced for use within tubs that do not have tile walls and is designed to be placed over the shower head.

The rim base and mount 42 are adhered to the bathtub tile wall using the large suction cup 28. The hoop 12 and net 20 are then hooked between the two ends of the slot key 54 so that they are fitted securely place. If the bathtub walls will not permit a suction cup 28 to hold the toy in place, the alternate style can be used and positioned over the shower head. This toy is easily removed for tile cleaning.

During bath time, this device 10 provides the child with a safe and entertaining toy while also providing a fun and effective means of cleaning.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A new and improved scrub-a-dub-hoop for providing enjoyment for a user in the bathtub with a simulated basketball game comprising, in combination:

a basketball hoop having an upper surface and a lower surface, the lower surface having a plurality of securement eyes thereon, the basketball hoop having a circular shape with an eight inch diameter;

a net having an upper end and a lower end, the upper end having a plurality of U-shaped securement strings thereattached, the U-shaped securement strings adapted for coupling with the plurality of securement eyes of the lower surface of the basketball hoop;

a suction cup having an outer surface and an inner surface, the outer surface adapted for securement to a bathroom wall, a circular molded plastic piece having a first edge, a second edge, and an intermediate groove therebetween, the first edge secured to the inner surface of the suction cup;

a molded plastic rim base having an upper end and a lower end, the upper end integral with the lower surface of the basketball hoop, a securement aperture formed downward of the upper end, the lower end having a first extent and a second extent parallel to each other, the first extent having a slot key end integral with an outer surface thereof, the second extent having a slot key end integral with an outer surface thereof, the first extent and the second extent capable of separating to allow the securement aperture to secure to the intermediate groove of the circular molded plastic piece of the suction cup;

a generally U-shaped clasp removably secured to the slot key end of the first extent and the second extent of the molded plastic rim base, the clasp serving to provide a tight fit around the circular molded plastic piece; and a sponge ball serving as a ball to shoot through the basketball hoop and as a means of washing.

2. A scrub-a-dub-hoop for providing enjoyment for a user in the bathtub with a simulated basketball game comprising:

a basketball hoop having an upper surface and a lower surface, the lower surface having a plurality of securement eyes thereon, the basketball hoop having a circular shape with an eight inch diameter, the basketball hoop having a securement means coupling to a wall of the bathtub, the securement means is a suction cup having an outer surface and an inner surface, the outer surface adapted for securement to a bathroom wall, a circular molded plastic piece having a first edge, a second edge, and an intermediate groove therebetween, the first edge secured to the inner surface of the suction cup, a molded plastic rim base having an upper end and a lower end, the upper end integral with the lower surface of the basketball hoop, a securement aperture formed downward of the upper end, the lower end having a first extent and a second extent parallel to each other, the first extent having a slot key end integral with an outer surface thereof, the second extent having a slot key end integral with an outer surface thereof, the first extent and the second extent capable of separating to allow the securement aperture to secure to the intermediate groove of the circular molded plastic piece of the suction cup;

a net having an upper end and a lower end, the upper end having a plurality of U-shaped securement strings thereattached, the U-shaped securement strings adapted for coupling with the plurality of securement eyes of the lower surface of the basketball hoop; and a sponge ball serving as a ball to shoot through the basketball hoop and as a means of washing.

* * * * *